US005824459A

United States Patent [19]

Dickerson

[11] Patent Number: 5,824,459

[45] Date of Patent: Oct. 20, 1998

[54] SYMMETRICAL THORACIC CAVITY IMAGING RADIOGRAPHIC ELEMENT

[75] Inventor: Robert E. Dickerson, Hamlin, N.Y.

[73] Assignee: Eastman Kodak Company, Rochester, N.Y.

[21] Appl. No.: 909,313

[22] Filed: Aug. 14, 1997

[51] Int. Cl.[6] ..... G03C 1/46; G03C 5/16; G03C 1/035

[52] U.S. Cl. ..... 430/502; 430/508; 430/509; 430/966; 430/567; 430/604; 430/438

[58] Field of Search ..... 430/502, 508, 430/509, 966, 567, 604, 438

[56] References Cited

U.S. PATENT DOCUMENTS

| | | | |
|---|---|---|---|
| 4,803,150 | 2/1989 | Dickerson et al. | 430/502 |
| 4,994,355 | 2/1991 | Dickerson et al. | 430/509 |
| 5,108,881 | 4/1992 | Dickerson et al. | 430/502 |
| 5,449,599 | 9/1995 | Heremans | 430/567 |
| 5,470,700 | 11/1995 | Marui | 430/567 |
| 5,576,156 | 11/1996 | Dickerson | 430/502 |
| 5,639,591 | 6/1997 | Adachi | 430/567 |
| 5,716,774 | 2/1998 | Dickerson et al. | 430/571 |

*Primary Examiner*—Mark F. Huff
*Attorney, Agent, or Firm*—Carl O. Thomas

[57] ABSTRACT

A dual-coated radiographic element is disclosed that is capable of simultaneously providing acceptable thoracic cavity imaging of both heart and lung anatomical features while employing a symmetrical coating format. The element allows reduced processing times while avoiding wet pressure sensitivity. This is achieved by reducing crossover to less than 5 percent using a crossover reducing dye in a polydispersed tabular grain emulsion layer coated nearest each major surface of the support. The tabular grain emulsion contains a rhodium dopant. A polydispersed outer tabular grain emulsion layer is coated over the polydispersed tabular grain emulsion coated nearest the support. Total hydrophilic colloid per side and the distribution of silver between the emulsion layers is controlled to allow processing in less than 45 seconds while avoiding wet pressure sensitivity.

7 Claims, No Drawings

SYMMETRICAL THORACIC CAVITY IMAGING RADIOGRAPHIC ELEMENT

FIELD OF THE INVENTION

The invention relates to radiographic elements containing radiation-sensitive silver halide emulsions adapted to be exposed by a pair of intensifying screens.

DEFINITION OF TERMS

In referring to grains and emulsions containing two or more halides, the halides are named in order of ascending concentrations.

The term "high bromide" in referring to grains and emulsions indicates that bromide is present in a concentration of greater than 50 mole percent, based on silver.

The term "normalized molar concentration" in referring to rhodium concentrations based on silver, indicates the number of gram-molecular weights of rhodium present per gram-molecular weight of silver, divided (normalized) by the number of rhodium atoms present in the rhodium containing molecule.

The term "equivalent circular diameter" or "ECD" is employed to indicate the diameter of a circle having the same projected area as a silver halide grain.

The term "aspect ratio" designates the ratio of grain ECD to grain thickness (t).

The term "tabular grain" indicates a grain having two parallel crystal faces which are clearly larger than any remaining crystal faces and an aspect ratio of at least 2.

The term "tabular grain emulsion" refers to an emulsion in which tabular grains account for greater than 50 percent of total grain projected area.

The term "coefficient of variation" or "COV" is defined as the standard deviation ($\sigma$) of grain ECD divided by mean grain ECD. COV is multiplied by 100 when stated as a percentage.

The term "log E" represents the log of exposure, measured in luxseconds.

The term "point $\gamma$" or "point gamma" is the slope of a line plotted tangent to a referenced point on a characteristic curve (a plot of image density versus log E). The slope of the line is calculated as the change in density ($\Delta D$) between two points on the line divided by the change in log exposure ($\Delta E$) between the same two points.

The terms "front" and "back" in referring to radiographic imaging are used to designate locations nearer to and farther from, respectively, the source of X-radiation than the support of the radiographic element.

The term "dual-coated" is used to indicate a radiographic element having emulsion layers coated on both the front and back sides of its support.

The term "crossover" refers to the light emitted by an intensifying screen mounted adjacent one side of a dual-coated radiographic element that is absorbed by one or more emulsion layers on the opposite side of the radiographic element support.

The term "symmetrical" in referring to radiographic elements indicates that the front and back sides of the elements have interchangeable (usually identical) imaging properties.

The term "symmetrical" in referring to radiographic elements indicates that the front and back sides of the elements differ significantly in their imaging properties.

The term "overall processing" refers to processing that occurs between the time an image-wise exposed element is introduced into a processor and the time the element emerges dry. The processing steps include development, fixing, washing and drying.

The term "rapid access processing" refers to overall processing in less than 90 seconds.

The term "fully forehardened" means that the hydrophilic colloid layers are forehardened in an amount sufficient to reduce swelling of these layers to less than 300 percent, percent swelling being determined by (a) incubating the radiographic element at 38° C. for 3 days at 50 percent relative humidity, (b) measuring layer thickness, (c) immersing the radiographic element in distilled water at 21° C. for 3 minutes, and (d) determining the percent change in layer thickness as compared to the layer thickness measured in step (b).

*Research* Disclosure is published by Kenneth Mason Publications, Ltd., Dudley House, 12 North St., Emsworth, Hampshire P010 7DQ, England.

BACKGROUND

In medical diagnostic imaging X-radiation is passed through a portion of a patient's anatomy. The pattern of X-radiation that passes through the patient is recorded in one or more radiation-sensitive emulsion layers of a radiographic film. To reduce the amount of X-radiation to which the patient must be subjected, the radiographic element is commonly dual-coated—that is, emulsion layers are coated on the front and back sides of the support. This reduces the amount of X-radiation required for imaging by half. A much larger reduction in X-radiation exposure is realized by using an intensifying screen to absorb X-radiation and emit light to the radiographic element for capture by a silver halide emulsion layer. Dual-coated radiographic elements are usually placed between a pair of intensifying screens and mounted in a cassette for exposure. With this arrangement the patient's exposure can be less than one twentieth of that which would otherwise be required to imagewise expose a single emulsion layer directly by X-radiation exposure. For most applications the speed advantage (X-radiation exposure reduction) more than offsets reductions in image sharpness attributable to crossover.

There is no single radiographic element that adequately serves all medical diagnostic needs. The degree to which X-radiation is absorbed varies widely from one anatomical region to the next. For example, lungs, which are filled with air, absorb relatively low levels of X-radiation while much higher levels of X-radiation are absorbed in heart imaging.

Thoracic cavity imaging provides one of the most difficult imaging challenges of radiographic imaging, since it is desired that a single image provide diagnostic image quality in both lung areas, the least dense tissue of the human body, and in heart and mediastinum areas, the densest portion of the human body.

Dickerson and Bunch U.S. Pat. No. 4,994,355 were the first to show that this challenge could be met. Dickerson and Bunch constructed a dual-coated radiographic element with near zero crossover characteristics. In a first layer coated nearest the support on each major face a hydrophilic colloid layer was coated containing a particulate processing solution decolorizable dye. On one side of the support a realtively high contrast emulsion layer was coated for lung imaging and on the other side of the support a relatively low contrast film was coated for heart imaging. It was demonstrated that adequate contrasts for both heart and lung imaging could be simultaneously obtained.

While advancing the state of the art and finding immediate commercial use, the radiographic elements of Dickerson and Bunch nevertheless have posed some disadvantages. First, these radiographic elements are asymmetrical—that is, the film has front and back sides that differ in their imaging properties. To get reproducible results it is necessary that the front and back orientation of the radiographic element as it is mounted in a cassette between a pair of intensifying screens must not change. Hence, the risk of operator error or the necessity of an additional feature to obviate the risk of misorientation.

Second, these radiographic elements, while capable of rapid access processing, are not capable of processing at the significantly lower overall processing times now being increasingly demanded by users.

Dickerson U.S. Pat. No. 5,576,156 discloses symmetrical radiographic elements capable of processing in less than 45 seconds, but incapable of thoracic imaging matching that of Dickerson and Bunch.

SUMMARY OF THE INVENTION

In one aspect this invention is directed to a medical diagnostic radiographic element comprised of a film support having first and second major surfaces and capable of transmitting radiation to which the radiographic element is responsive and, coated on each of the major surfaces, processing solution permeable hydrophilic colloid layers which are fully forehardened including at least one spectrally sensitized tabular grain emulsion, a particulate dye (a) capable of absorbing radiation to which the silver halide grains are responsive, (b) present in an amount sufficient to reduce crossover to less than 5 percent, and (c) capable of being substantially decolorized during processing, wherein, to facilitate medical diagnostic imaging of thoracic cavity anatomical features as well as rapid processing with low wet pressure sensitivity in a symmetrical film format, less than 35 mg/dm$^2$ of hydrophilic colloid is coated on each of the major surfaces of the support, the hydrophilic colloid layers including on each major surface of the support inner and outer emulsion layers containing a spectrally sensitized tabular grain emulsion having a grain equivalent circular diameter coefficient of variation of greater than 25 percent, the outer emulsion layers being coated over the inner emulsion layers, the outer emulsion layers contain (a) silver halide grains accounting for from 30 to 70 percent of the total weight of the outer layers, and (b) from 20 to 80 percent of the total silver forming the silver halide grains within the radiographic element, the inner emulsion layers contain (a) the dye particles and (b) from 20 to 80 percent of the total silver forming the silver halide grains within the radiographic element, the dye particles and the silver halide grains together account for from 30 to 70 percent of the total weight of each of the inner emulsion layers, and the silver halide grains within the inner emulsion layers contain a rhodium dopant to increase point $\gamma$(a) to greater than 3.0 at a first reference point at a density of 2.0 above minimum density, (b) to greater than 1.5 at a second reference point lying at a 0.3 log E lower exposure than the first reference point, and (c) to greater than 0.5 at a third reference point lying at a 0.6 log E lower exposure than the first reference point.

Quite surprisingly, the radiographic element of the invention, though symmetrical, is capable of satisfying the requirements of thoracic imaging. Further, the radiographic element is capable of overall processing in less than 45 seconds and even less than 30 seconds without exhibiting wet pressure sensitivity. The performance comparisons in the Examples demonstrate that the features of the invention are required to realize this combination of performance capabilities.

DESCRIPTION OF PREFERRED EMBODIMENTS

Assembly A

This is an assembly of a radiographic element according to the invention positioned between two intensifying screens.

| | |
|---|---|
| FS | Front Screen |
| | SS1 Screen Support |
| | FLE Front Luminescence Emitting Layer |
| RE | Radiographic Element |
| | FE2 Outer Front Hydrophilic Colloid Layer |
| | FE1 Inner Front Hydrophilic Colloid Layer |
| | S1 Subbing Layer |
| | TF Transparent Film Support |
| | S2 Subbing Layer |
| | BE1 Inner Back Hydrophilic Colloid Layer |
| | BE2 Outer Back Hydrophilic Colloid Layer |
| BS | Back screen |
| | BLE Back Luminescence Emitting Layer |
| | SS2 Screen Support |

Assembly A is shown comprised of a medical diagnostic radiographic element RE satisfying thoracic cavity imaging requirements positioned between front and back intensifying screens FS and BS comprised of supports SS1 and SS2 and layers FLE and BLE that absorb X-radiation and emit light.

Located between the screens when intended to be imagewise exposed is radiographic element RE satisfying the requirements of the invention. The radiographic element is comprised of a transparent support TF, which is usually a transparent film support and is frequently blue tinted. To facilitate coating onto the support, subbing layers S1 and S2 are shown. Subbing layers are formed as an integral part of transparent film supports, but are not essential for all types of transparent supports. The transparent support and the subbing layers are all transparent to light emitted by the intensifying screens and are also processing solution impermeable. That is, they do not ingest water during processing and hence do not contribute to the "drying load"—the water that must be removed to obtain a dry imaged element.

Inner and outer hydrophilic colloid layers FE1 and FE2, respectively, are coated on the major surface of the support positioned adjacent the front intensifying screen. Similarly, inner and outer hydrophilic colloid layers BE1 and BE2 are coated on the major surface of the support positioned adjacent the back intensifying screen. Also usually present, but not shown, are hydrophilic colloid layers, referred to as surface overcoats, that overlie FE2 and BE2 and perform the function of physically protecting the underlying hydrophilic colloid layers during handling and processing. In addition to hydrophilic colloid the overcoats can contain matting agents, antistatic agents, lubricants and other nonimaging addenda at or near the surface of the element. It is also common practice to coat a hydrophilic colloid interlayer between a surface overcoat and underlying emulsion layers. The interlayer can contain the same types of addenda as the surface overcoat, but is also commonly free of addenda, thereby acting primarily simply to provide a physical separation between the surface overcoat and its addenda and the underlying emulsion layers.

The medical diagnostic radiographic elements of the invention satisfying thoracic cavity imaging requirements differ from radiographic elements previously available in the art by offering a combination of advantageous characteristics never previously realized in a single radiographic element:

(1) Full forehardening.

(2) Symmetrical format.

(3) Crossover of less than 5 percent.

(4) Processing in less than 45 seconds.

(5) Low wet pressure sensitivity.

(6) Relatively high levels of sensitivity.

(7) Acceptable image contrasts simultaneously realizable in heart and lung imaging regions. While prior to the present invention the combination of characteristics (1)–(7) have been thought to impose incompatible construction requirements, by a combination of careful selection of components and a realization of unexpected performance characteristics, this invention succeeds for the first time in combining all of these characteristics in a single radiographic element.

The radiographic element RE is fully forehardened. This better protects the radiographic element from damage in handling and processing and simplifies processing by eliminating any necessity of completing hardening during processing. Full forehardening is achieved by hardening the hydrophilic colloid layers. The levels of forehardening of a fully forehardened radiographic element are similar to those employed in forehardening photographic elements. A summary of vehicles for photographic elements including hydrophilic colloids, employed as peptizers and binders, and useful hardeners is contained in *Research Disclosure*, Vol. 389, September 1996, Item 38957, Section II. Vehicles, vehicle extenders, vehicle-like addenda and vehicle related addenda. Preferred vehicles for the hydrophilic colloid layers FE1, FE2, BE1 and BE2 as well as protective overcoats, if included, are gelatin (e.g., alkali-treated gelatin or acid-treated gelatin) and gelatin derivatives (e.g., acetylated gelatin or phthalated gelatin). Although conventional hardeners can be used more or less interchangeably with little or no impact on performance, particularly preferred are the bis (vinylsulfonyl) class of hardeners, such as bis(vinylsulfonyl) alkylether or bis(vinylsulfonyl)alkane hardeners, where the alkyl moiety contains from 1 to 4 carbon atoms.

For the radiographic element to be capable of forming an image, it must include at least one radiation-sensitive silver halide emulsion. The fully forehardened characteristic (1) restricts the choices of the silver halide emulsions in the following manner: It is well recognized in the art that silver image covering power can decline as a function of increased levels of forehardening. Covering power is expressed as image density divided by silver coating coverage. For example, Dickerson U.S. Pat. No. 4,414,304 defines covering power as 100 times the ratio of maximum density to developed silver, expressed in $mg/dm^2$. Dickerson recognized that tabular grain emulsions are less susceptible to covering power reduction with increasing levels of forehardening.

If the hydrophilic colloid layers are not fully forehardened, excessive water pick up during processing prevents processing in less than 45 seconds, characteristic (4). If non-tabular grain emulsions are substituted for tabular grain emulsions, full forehardening requires excessive amounts of silver and characteristics (4) and (5) cannot be both realized. If the hydrophilic colloid is increased in proportion to the increase in silver, processing cannot be completed in less than 45 seconds. If silver is increased without increasing the hydrophilic colloid, the processed radiographic element will show localized density marks indicative of roller pressure applied in passing the exposed element through the processor, generally referred to as wet pressure sensitivity. Tabular grain emulsions frequently display higher levels of wet pressure sensitivity than non-tabular grain emulsions.

To satisfy thoracic cavity imaging requirements (7) in a symmetrical format (2), a unique combination of tabular grain emulsion layers must be employed. The overlying emulsion layers FE2 and BE2 are tabular grain emulsion layers that exhibit a coefficient of variation (COV) of grain equivalent circular diameter (ECD) of less than 15 percent, preferably 10 percent or less. The underlying emulsion layers FE1 and BE1 are tabular grain emulsion layers that exhibit a COV of greater than 25 percent and contain rhodium as a grain dopant.

Tabular grain silver halide emulsions contemplated for use in the practice of the invention can be of any of the following silver halide compositions: silver chloride, silver bromide, silver iodobromide, silver chlorobromide, silver bromochloride, silver iodochloride, silver iodochlorobromide and silver iodobromochloride, where the mixed halides are named in order of ascending concentrations. Since it is recognized that the presence of iodide slows grain development, it is advantageous to choose emulsions that contain no iodide or only limited levels of iodide. Iodide concentrations of less than 4 mole percent, based on silver, are specifically preferred. Of the three photographic halides (chloride, bromide and iodide), silver chloride has the highest solubility and hence lends itself to achieving the highest rates of development. It is therefore preferred in terms of achieving characteristic (4). When characteristics (4) and (6) are considered together, silver chlorobromide and silver bromide compositions are preferred.

The tabular grain emulsions are preferably chosen so that tabular grains having thicknesses of less than 0.3 $\mu$m, most preferably less than 0.2 $\mu$m, in thickness account for greater than 70 percent and most preferably at least 90 percent of total grain projected area. Although the covering power of the tabular grains increases as their thickness is decreased, it is usually preferred to maintain average tabular grain thicknesses of at least about 0.1 $\mu$m to avoid undesirably warm image tones in the fully processed radiographic elements. It is generally recognized that tabular grain emulsions useful for imaging can have mean ECD's ranging up to about 10 $\mu$m, but in practice mean ECD's rarely exceed 5 $\mu$m and are typically less than 3 $\mu$m. The choice of mean grain sizes (ECD's) is dictated by balancing imaging speed and granularity (noise). Both speed and granularity are known to increase with increasing grain sizes. However, as taught by Kofron et al U.S. Pat. No. 4,439,520, spectrally sensitized tabular grain emulsions exhibit a superior speed-granularity relationship as compared to non-tabular grains coated at the same silver coverages. At the same mean ECD's greater than about 0.6 $\mu$m tabular grain emulsions are far superior to non-tabular grain emulsions in terms of granularity.

Conventional tabular grain emulsions having COV's of greater than percent satisfying FE1 and BE1 requirements are illustrated in *Research Disclosure,* Item 38957, I. Emulsion grains and their preparation, B. Grain morphology, paragraphs (1)–(3).

Conventional high (>50 mole %) chloride tabular grain emulsions satisfying FE1 and BE1 requirements are illustrated by Wey et al U.S. Pat. No. 4,414,306;
Maskasky U.S. Pat. No. 4,400,463;
Maskasky U.S. Pat. No. 4,713,323;
Takada et al U.S. Pat. No. 4,783,398;
Nishikawa et al U.S. Pat. No. 4,952,491;
Ishiguro et al U.S. Pat. No. 4,983,508;

Tufano et al U.S. Pat. No. 4,804,621;
Maskasky U.S. Pat. No. 5,061,617;
Maskasky U.S. Pat. No. 5,178,997;
Maskasky and Chang U.S. Pat. No. 5,178,998;
Maskasky U.S. Pat. No. 5,183,732;
Maskasky U.S. Pat. No. 5,185,239;
Maskasky U.S. Pat. No. 5,217,858;
Chang et al U.S. Pat. No. 5,252,452;
Maskasky U.S. Pat. No. 5,264,337;
Maskasky U.S. Pat. No. 5,272,052;
Maskasky U.S. Pat. No. 5,275,930;
Maskasky U.S. Pat. No. 5,292,632;
Maskasky U.S. Pat. No. 5,298,387;
Maskasky U.S. Pat. No. 5,298,388;
House et al U.S. Pat. No. 5,320,938;
Maskasky U.S. Pat. No. 5,558,982;
Maskasky U.S. Pat. No. 5,607,828

Conventional high (>50 mole %) bromide tabular grain emulsions compatible with requirements of the radiographic elements of this invention are illustrated by the following citations:

Abbott et al U.S. Pat. No. 4,425,425;
Abbott et al U.S. Pat. No. 4,425,426;
Kofron et al U.S. Pat. No. 4,439,520;
Maskasky U.S. Pat. No. 4,713,320;
Ikeda et al U.S. Pat. No. 4,806,461;
Ohashi et al U.S. Pat. No. 4,835,095;
Makino et al U.S. Pat. No. 4,835,322;
Daubendiek et al U.S. Pat. No. 4,914,014;
Aida et al U.S. Pat. No. 4,962,015;
Black et al U.S. Pat. No. 5,219,720;
Dickerson et al U.S. Pat. No. 5,252,443;
Delton U.S. Pat. No. 5,310,644;
Chaffee et al U.S. Pat. No. 5,358,840;
Delton U.S. Pat. No. 5,372,927;
Maskasky U.S. Pat. No. 5,620,840.

Tabular grain emulsions satisfying FE1 and BE1 requirements of the invention can be prepared with low coefficients of variation by employing techniques such as those taught by Research Disclosure, Item 38957, I. Emulsion grains and their preparation, E. Blends, layers and performance characteristics, paragraph (2). Preferred emulsion precipitations that produce tabular grain emulsions with COV's of less than 15 percent and, in preferred forms, less than 10 percent, are disclosed by Tsaur et al U.S. Pat. Nos. 5,147,771, 5,147,772, 5,147,773, 5,147,774 and 5,210,013; Kim et al U.S. Pat. Nos. 5,236,817 and 5,272,048; Sutton et al U.S. Pat. No. 5,300,413; and Mignot et al U.S. Pat. No. 5,484,697, the disclosures of which are here incorporated by reference.

Although Dickerson and Bunch achieved contrasts useful for simultaneous heart and lung imaging by coating high and low contrast emulsions with higher and lower levels of grain size dispersity, respectively, on opposite sides of a support, it has been observed that when the polydispersed (COV >25%) and monodispersed (COV <15%) tabular grain emulsions are each coated on both sides of the support, contrasts diagnostically useful for simultaneous heart and lung imaging are not realized.

It has been discovered that when (but only when) crossover is reduced to less than 5 percent, feature (3), the addition of rhodium as a dopant to the silver halide grains in FE1 and BE1 allows contrasts suitable for simultaneously obtaining diagnostically useful heart and lung images to be obtained.

This was not predictable. Keller *Science and Technology of Photography,* VCH, New York, 1993, at page 40 states:

> A fundamentally different approach to high gradation values is the doping of the emulsion grains with heavy-metal ion such as those of rhodium, cadmium, lead and bismuth. Doping pushes back the toe of the characteristic curve and produces a steep gradation.

The expression "pushes back the toe" means simply that more light exposure is required before density rises above a minimum level. Thus, it was expected that the addition of rhodium to the polydisperse tabular grain emulsion would lower, not raise contrast in lower density (higher speed) portions of the characteristic curve produced by the element where heart imaging occurs. Further, the added requirement of a crossover level of less than 5 percent to achieve acceptable heart imaging, was not predicted.

It is believed that rhodium is effective as a dopant at any concentration known to be useful for modifying imaging contrast. Thus, in most instances rhodium in $1\times10^{-9}$ normalized molar concentrations based on silver in the first layer are contemplated.

If larger than required levels of rhodium are employed, there is a risk of reducing overall imaging speeds, thereby requiring the patient to be subjected to higher than otherwise needed levels of X-radiation. Larger rhodium concentrations can alternatively be offset by employing larger mean ECD grain sizes in the first emulsion layers. This is, of course, limited by the level to which increased image granularity can be accepted.

It is generally preferred to limit rhodium to a normalized molar concentration based on silver of less than $1\times10^{-6}$. If rhodium is limited to $1\times10^{-7}$ normalized molar concentrations based on silver in the first emulsion layers, no significant reductions in speed are associated with the addition of rhodium as a dopant. In most instances it is preferred to employ rhodium as a dopant in a normalized molar concentrations in the range of from $1\times10^{-9}$ to $1\times10^{-7}$ based on silver. An optimum rhodium normalizd molar concentration range is from $5\times10^{-9}$ to $5\times10^{-8}$ based on silver.

Any conventional rhodium compound known to be useful in doping silver halide grains can be employed in the practice of the invention. A variety of rhodium and other conventional silver halide grain dopants are disclosed by *Research Disclosure,* Item 38957, I. Emulsions and their preparation, D. Grain modifying conditions and adjustments, paragraphs (3), (4) and (5). Rhodium can be introduced as a simple salt, preferably a halide salt. It is now believed rhodium forms a hexacoordination complex prior to incorporation in the crystal lattice of a silver halide grain. Thus, in most instances rhodium hexahalide coordination complexes are preferred dopants, with up to two halide atoms being sometimes replaced with aquo ligands. Preferred halides in the rhodium compounds are chloride and bromide. Paragraphs (4) and (5) provide specific illustrations of other ligands, including organic ligands, that can be present in rhodium hexacoordination complexes.

Rhodium dopants are compatible with other conventional dopants. Combinations of rhodium and speed increasing dopants, particularly shallow electron trapping dopants, such as those described in *Research Disclosure,* Vol. 367, Nov. 1994, Item 36736, and Olm et al U.S. Pat. No. 5,503,970, here incorporated by reference, are specifically contemplated. Conventional iridium dopants can also be employed in combination with rhodium dopants. Iridium dopants, like rhodium dopants, are believed to enter the silver halide grain crystal lattice as hexacoordination complexes, most commonly iridium hexahalide (preferably chloride or bromide) coordination complexes.

Conventional levels of silver are coated on each side of the support. Since thoracic cavity imaging does not rely on high image densities, relatively low levels of silver can be employed. For example, lung image information is generally sought generally sought in a density region centered around 2.0 above minimum density while heart image information is generally obtained at lower density levels. Thus, silver coverages per side ranging down to about 20 mg/dm$^2$ are contemplated. Overall processing times of less than 45 seconds can be achieved with silver coating coverages of up to 60 mg/dm$^2$ per side. A preferred silver coating range is from 25 to 50 mg/dm$^2$.

If all of the radiation-sensitive silver halide grains are spectrally sensitized, this alone is capable of reducing crossover to just less than 20 percent, as illustrated by Abbott et al U.S. Pat. Nos. 4,425,425 and 4,425,426 (hereinafter referred to collectively as Abbott et al).

All references to crossover percentages are based on the crossover measurement technique described in Abbott et al, here incorporated by reference. The crossover of a radiographic element according to the invention under the contemplated conditions of exposure and processing can be determined by substituting a black object (e.g., kraft paper) for one of the two intensifying screens. To provide a verifiable standard for measuring percent crossover, the exposure and processing described in the Examples, below, should be employed. Exposure through a stepped density test object exposes primarily the emulsion on the side of the radiographic element nearest the intensifying screen, but the emulsion on the side of the radiographic element farthest from the intensifying screen is also exposed, but to a more limited extent by unabsorbed light passing through the support. By removing emulsion from the side of the support nearest the intensifying screen in one sample and the side of the support farther from the intensifying screen in another sample, a characteristic curve (density vs. log E, where E is the light passing through the stepped test object) can be plotted for each emulsion remaining. The characteristic curve of the emulsion on the side farthest from the substituted light source is laterally displaced as compared to the characteristic curve of the emulsion on the side nearest the substituted light source. An average displacement ($\Delta$log E) is determined and used to calculate percent crossover as follows:

$$\text{Percent Crossover} = \frac{1}{\text{antilog}(\Delta\log E)} \times 100 \qquad \text{(I)}$$

If screen emission is in the spectral region to which silver halide possesses native sensitivity, then the silver halide grains themselves contribute to light absorption and therefore crossover reduction. This occurs to a significant extent only at exposure wavelengths of less than 425 nm. Spectral sensitizing dye adsorbed to the grain surfaces is primarily relied upon for absorption of light emitted by the screens. The silver halide emulsions can contain any conventional spectral sensitizing dye or dye combination adsorbed to the grain surfaces. Typically dye absorption maxima are closely matched to the emission maxima of the screens so that maximum light capture efficiency is realized. To maximize speed (6) and minimize crossover (3), it is preferred to adsorb dye to the grain surfaces in a substantially optimum amount—that is, in an amount sufficient to realize at least 60 percent of maximum speed under the contemplated conditions of exposure and processing. To provide an objective standard for reference the conditions of exposure and processing set out in the Examples below can be employed. Illustrations of spectral sensitizing dyes useful with the radiographic elements of the invention are provided by Kofron et al U.S. Pat. No. 4,439,520, here incorporated by reference, particularly cited for its listing of blue spectral sensitizing dyes. Abbott et al U.S. Pat. Nos. 4,425,425 and 4,425,426 also illustrate the use of spectral sensitizing dyes to reduce crossover. A more general summary of spectral sensitizing dyes is provided by Research Disclosure, Item 38957, cited above, Section V. Spectral sensitization and desensitization, A. Sensitizing dyes.

To reduce crossover to less than 5 percent, including down to essentially no ("zero") crossover, it is contemplated to introduce additional dye capable of absorbing within the wavelength region of exposure into the hydrophilic colloid layers FE1 and BE1. The additional dye is chosen to absorb exposing light that is not absorbed by the silver halide grains and spectral sensitizing dye contained in hydrophilic colloid layers FE2 and BE2. If the additional dye is incorporated into the hydrophilic colloid layers FE2 and BE2 as well, the result is a marked reduction in photographic speed. In addition to its absorption properties the additional dye must be capable of being decolorization during processing.

Dickerson et al U.S. Pat. Nos. 4,803,150 and 4,900,652, here incorporated by reference, disclose particulate dyes capable of (a) absorbing radiation to which the silver halide grains are responsive to reduce crossover to less than 15 percent and (b) being substantially decolorized during processing. The particulate dyes can, in fact, substantially eliminate crossover. The mean ECD of the dye particles can range up to 10 $\mu$m, but is preferably less than 1 $\mu$m. Dye particle sizes down to about 0.01 $\mu$m can be conveniently formed. Where the dyes are initially crystallized in larger than desired particle sizes, conventional techniques for achieving smaller particle sizes can be employed, such as ball milling, roller milling, sand milling, and the like.

Since the hydrophilic colloid layers are typically coated as aqueous solutions in the pH range of from 5 to 6, most typically from 5.5 to 6.0, the dyes are selected to remain in particulate form at those pH levels in aqueous solutions. The dyes must, however, be readily soluble at the alkaline pH levels employed in photographic development. Dyes satisfying these requirements are nonionic in the pH range of coating, but ionic under the alkaline pH levels of processing. Preferred dyes are nonionic polymethine dyes, which include the merocyanine, oxonol, hemioxonol, styryl and arylidene dyes. In preferred forms the dyes contain carboxylic acid substituents, since these substituents are nonionic in the pH ranges of coating, but are ionic under alkaline processing conditions.

Specific examples of particulate dyes are described by Lemahieu et al U.S. Pat. No. 4,092,168, Diehl et al WO 88/04795 and EPO 0 274 723, and Factor et al EPO 0 299 435, Factor et al U.S. Pat. No. 4,900,653, Diehl et al U.S. Pat. No. 4,940,654 (dyes with groups having ionizable protons other than carboxy), Factor et al U.S. Pat. No. 4,948,718 (with arylpyrazolone nucleus), Diehl et al U.S. Pat. No. 4,950,586, Anderson et al U.S. Pat. No. 4,988,611 (particles of particular size ranges and substituent pKa values), Diehl et al U.S. Pat. No. 4,994,356, Usagawa et al U.S. Pat. No. 5,208,137, Adachi U.S. Pat. No. 5,213,957 (merocyanines), Usami U.S. Pat. No. 5,238,798 (pyrazolone oxonols), Usami et al U.S. Pat. No. 5,238,799 (pyrazolone oxonols), Diehl et al U.S. Pat. No. 5,213,956 (tricyanopropenes and others), Inagaki et al U.S. Pat. No. 5,075,205, Otp et al U.S. Pat. No. 5,098,818, Texter U.S. Pat. No. 5,274,109, McManus et al U.S. Pat. No. 5,098,820, Inagaki et al EPO 0 385 461, Fujita et al EPO 0 423 693, Usui EPO 0 423 742 (containing groups with specific pKa values), Usagawa et al EPO 0 434 413 (pyrazolones with particular sulfamoyl, carboxyl and similar substituents), Jimbo et al EPO 0 460 550, Diehl et al EPO 0 524 593

(having alkoxy or cyclic ether substituted phenyl substituents), Diehl et al EPO 0 524 594 (furan substituents) and Ohno EPO 0 552 646 (oxonols). If all of the silver halide required for imaging is located in the hydrophilic colloid layers FE2 and BE2, it is impossible satisfy characteristics (4) and (5). If hydrophilic colloid is reduced to less than 35 mg/dm$^2$ per side, processing in less than 45 seconds (4) can be realized, but high levels of wet pressure sensitivity are observed. Wet pressure sensitivity is observed as uneven optical densities in the fully processed image, attributable to differences in guide roller pressures applied in rapid processing. If the amount of hydrophilic colloid in the layers FE2 and BE2 is increased to an extent necessary to eliminate visible wet pressure sensitivity, the radiographic element cannot be processed in less than 45 seconds.

It has been discovered that successful rapid processing and low levels of wet pressure sensitivity can be both realized if a portion of the spectrally sensitized radiation-sensitive silver halide relied upon for imaging is incorporated in the hydrophilic colloid layers FE1 and BE1. Surprisingly, as demonstrated in the Examples below, when a portion of the spectrally sensitized radiation-sensitive silver halide is coated in the hydrophilic colloid layers containing the particulate dye used for crossover reduction, fully acceptable photographic speeds can still be maintained. This is in direct contradiction to observations that particulate dye and silver halide emulsion blending in a single hydrophilic colloid result in unacceptably low levels of photographic speed. By incorporating both a portion of the silver halide emulsion and the particulate dye in hydrophilic colloid layers FE1 and BE1, it is possible to reduce the total coverage of hydrophilic colloid per side of the radiographic elements of the invention to less than 35 mg/dm$^2$, preferably less than 33 mg/dm$^2$ while satisfying characteristics (1)–(7). In preferred forms of the invention, the low levels of hydrophilic colloid per side allow processing characteristic (4) to be reduced to less than 35 seconds.

To satisfy characteristics (1)–(7), from 20 to 80 (preferably 30 to 70) percent of the total silver forming the radiographic element must be contained in the hydrophilic colloid layers FE2 and BE2. Similarly, from 20 to 80 (preferably 30 to 70) percent of the total silver forming the radiographic element must be contained in the hydrophilic colloid layers FE1 and BE1. It is generally preferred that at least 50 percent of the total silver forming the radiographic element be contained in the hydrophilic colloid layers FE2 and BE2.

In addition, to satisfy characteristics (1)–(7), the silver halide grains in hydrophilic colloid layers FE2 and BE2 account for from 30 to 70 (preferably 40 to 60) percent of the total weight of these layers. Similarly, in hydrophilic colloid layers FE1 and BE1 the silver halide grains and dye particles together account for from 30 to 70 (preferably 40 to 60) percent of the total weight of these layers.

The quantification of acceptable image contrasts for simultaneous diagnostic imaging of both heart and lung regions of the thoracic cavity, satisfying characteristic (7), is undertaken in terms of point gammas or point γ's. For improved diagnostic imaging of lung tissue the radiographic elements provide a point γ of greater than 3.0 at a characteristic curve first reference point at a density of 2.0 above minimum density. For improved diagnostic imaging of heart areas of the anatomy (i.e., the mediastinum) a point γ of greater than 0.5 is required at a reference point on the characteristic curve that lies at a 0.6 log E lower exposure than the first reference point. The point γ of greater than 0.5 at a 0.6 log E lower exposure than the first reference point is not ideal, merely a useful threshold for heart area imaging that can be obtained concurrently with diagnostically useful lung area imaging. Preferably the point γ at a 0.6 log E lower exposure than the first reference point is at least 0.6 and optimally at least 0.7. To further define the characteristic curve, a point γ of greater than 1.5 is obtained at a 0.3 log E lower exposure than the first reference point. It is preferred that the radiographic element have a useful imaging exposure range of at least 1.0 log E, since the mediastinum typically absorbs about 10 times the amount of X-radiation absorbed in low density lung tissue.

Specific selections of remaining features of the radiographic element RE can take any convenient conventional form compatible with the descriptions provided. For example, transparent film supports and the subbing layers that are typically provided on their major surfaces to improve the adhesion of hydrophilic colloid layers are disclosed in *Research Disclosure,* Item 38957, Section XV. Supports and in *Research Disclosure,* Item 18431, Section XII. Film Supports. Chemical sensitization of the emulsions is disclosed in *Research Disclosure,* Item 36544, Section IV. Chemical sensitization and *Research Disclosure,* Item 18431, Section I.C. Chemical Sensitization/Doped Crystals. The chemical sensitization of tabular grain emulsions is more particularly taught in Kofron et al U.S. Pat. No. 4,429,520, here incorporated by reference.

The following sections of *Research Disclosure,* Item 18431 summarize additional features that are applicable to the radiographic elements of the invention:

II. Emulsion Stabilizers, Antifoggants and Antikinking Agents

III. Antistatic Agents/Layers

IV. Overcoat Layers

The following sections of *Research Disclosure,* Item 38957 summarize additional features that are applicable to the radiographic elements of the invention:

VII. Antifoggants and stabilizers

IX. Coating physical property modifying addenda

A. Coating aids

B. Plasticizers and lubricants

C. Antistats

D. Matting Agents

EXAMPLES

The invention can be better appreciated by consideration in connection with the following specific embodiments. The letters c and e are appended to element numbers to differentiate control and example radiographic elements. All coating coverages are in mg/dm$^2$, except as otherwise indicated.

Radiographic Element Ac

A conventional asymmetric dual-coated thoracic cavity imaging element was provided having the following format:

| |
|---|
| Surface Overcoat (SOC) |
| Interlayer (IL) |
| Front Emulsion Layer (FEL) |
| Crossover Control Layer (CCL) |
| Transparent Film Support |
| Crossover Control Layer (CCL) |
| Back Emulsion Layer (BEL) |
| Interlayer (IL) |
| Surface Overcoat (SOC) |

-continued

| Surface Overcoat (SOC) | |
|---|---|
| Contents | Coverage |
| Gelatin | 3.4 |
| Poly(methyl methacrylate) matte beads | 0.14 |
| Carboxymethyl casein | 0.57 |
| Colloidal silica | 0.57 |
| Polyacrylamide | 0.57 |
| Chrome alum | 0.025 |
| Resorcinol | 0.058 |
| Whale oil lubricant | 0.15 |

The SOC layer on the back side of the support additionally contained a marker dye to allow visual verification of orientation, as described in Dickerson U.S. Pat. No. 5,252,443.

| Contents | Coverage |
|---|---|
| Interlayer (IL) | |
| Gelatin | 3.4 |
| AgI Lippmann (0.08 μm) | 0.11 |
| Carboxymethyl casein | 0.57 |
| Colloidal silica | 0.57 |
| Polyacrylamide | 0.57 |
| Chrome alum | 0.025 |
| Resorcinol | 0.058 |
| Nitron | 0.044 |
| Front Emulsion Layer (FEL) | |
| Ag | 23.7 |
| Gelatin | 31.2 |
| 4-Hydroxy-6-methyl-1,3,3a,7-tetraazaindene | 2.1 g/Ag mole |
| Potassium nitrate | 1.8 |
| Ammonium hexachloropalladate | 0.0022 |
| Maleic acid hydrazide | 0.0087 |
| Sorbitol | 0.53 |
| Glycerin | 0.57 |
| Potassium Bromide | 0.14 |
| Resorcinol | 0.44 |
| Bis(vinylsulfonylmethyl)ether | 2.4% |

(based on wt. of gelatin in all layers of the front side of the support)

The front emulsion layer contained a tabular grain silver bromide emulsion. The grains had a mean ECD of 1.8 μm and the tabular grains had a mean thickness of 0.13 μm. Tabular grains accounted for greater than 90 percent of total grain projected area. The COV of grain ECD was 10 percent.

The emulsion was chemically sensitized with sodium thiosulfate, potassium tetrachloroaurate, sodium thiocyanate and potassium selenocyanate and spectrally sensitized with 400 mg/Ag mole of anhydro-5,5-dichloro-9-ethyl-3,3'-bis(3-sulfopropyl)oxacarbocyanine hydroxide, followed by the addition of 300 mg/Ag mole of KI.

Transparent Film Support

The transparent film support consisted of a conventional blue tinted polyester radiographic film support having a thickness of 177.8 μm.

| Back Emulsion Layer (BEL) | |
|---|---|
| Contents | Coverage |
| Ag (component E1) | 7.8 |
| Ag (component E2) | 10.1 |
| Gelatin | 31.2 |
| 4-Hydroxy-6-methyl-1,3,3a,7-tetraazaindene | 2.1 g/Ag mole |
| Potassium nitrate | 1.8 |

-continued

| Back Emulsion Layer (BEL) | |
|---|---|
| Contents | Coverage |
| Ammonium hexachloropalladate | 0.0022 |
| Maleic acid hydrazide | 0.0087 |
| Sorbitol | 0.53 |
| Glycerin | 0.57 |
| Potassium Bromide | 0.14 |
| Resorcinol | 0.44 |
| Bis(vinylsulfonylmethyl)ether | 2.4% |

(based on wt. of gelatin in all layers of the back side of the support)

Both of emulsions E1 and E2 were polydisperse tabular grain silver bromide emulsions. The grains of E1 and E2 had a mean ECD of 3.6 μm and 0.13 μm, respectively. The tabular grains of both emulsions had a mean thickness of 0.13 μm. Tabular grains accounted for greater than 50 percent of total grain projected area in both E1 and E2. The COV of grain ECD in each of the component emulsions was greater than 30 percent and was much higher in the resulting blended emulsion. The component emulsions were chemically and spectrally sensitized before blending as described above for the front emulsion.

| Crossover Control Layer | |
|---|---|
| Dye XOC-1 | 2.5 |
| Gelatin | 6.7 |

Dye XOC-1 was 1-(4'-carboxyphenyl)-4-(4'-dimethylaminobenzylidene)-3-ethoxycarbonyl-2-pyrazolin-5-one.

Radiographic Element Bc

This radiographic element was asymmetrically constructed similarly as radiographic element A, except that the grain size dispersity (COV) in the front emulsion layer was increased to greater than 30 percent. This was achieved by replacing the grain population in the front emulsion layer with a blended grain population provided by two tabular grain silver bromide emulsions E3 and E4. The grains of E3 and E4 had a mean ECD of 2.0 μm and 2.7 μm, respectively. The tabular grains in both emulsions had a mean thickness of 0.13 μm. Emulsions E3 and E4 were blended in a 60:40 weight ratio, based on silver. Chemical and spectral sensitization was as previously stated. The coating coverages of gelatin and the remaining layer components were not varied from radiographic element Ac.

Radiographic Element Cc

This radiographic element differed from radiographic elements Ac and Bc in substituting for the front and back emulsion layers and crossover control layers inner and outer emulsion layers that were identical in their front and back locations. Thus, the element was symmetrical.

The resulting symmetric dual-coated radiographic element had the following format:

| |
|---|
| Surface Overcoat (SOC) |
| Interlayer (IL) |
| Outer Emulsion Layer (OEL) |
| Inner Emulsion Layer (IEL) |
| Transparent Film Support |
| Inner Emulsion Layer (IEL) |
| Outer Emulsion Layer (OEL) |
| Interlayer (IL) |
| Surface Overcoat (SOC) |

The transparent film support, surface overcoats and interlayers were identical to those of radiographic element Ac, except that, since the element was symmetrical no marker dye was incorporated.

| Outer Emulsion Layer (OEL) | |
|---|---|
| Contents | Coverage |
| Ag | 13.1 |
| Gelatin | 12.9 |
| 4-Hydroxy-6-methyl-1,3,3a,7-tetraazaindene | 2.1 g/Ag mole |
| Potassium nitrate | 1.8 |
| Ammonium hexachloropalladate | 0.0022 |
| Maleic acid hydrazide | 0.0087 |
| Sorbitol | 0.53 |
| Glycerin | 0.57 |
| Potassium Bromide | 0.14 |
| Resorcinol | 0.44 |

The outer emulsion layer contained a tabular grain silver bromide emulsion. The grains had a mean ECD of 2.0 $\mu$m and the tabular grains had a mean thickness of 0.13 $\mu$m. Tabular grains accounted for greater than 50 percent of total grain projected area. The COV of grain ECD was 34 percent. Chemical and spectral sensitization was as previously stated.

| Inner Emulsion Layer (IEL) | |
|---|---|
| Contents | Coverage |
| Ag | 13.1 |
| Gelatin | 12.9 |
| 4-Hydroxy-6-methyl-1,3,3a,7-tetraazaindene | 2.1 g/Ag mole |
| Potassium nitrate | 1.8 |
| Ammonium hexachloropalladate | 0.0022 |
| Maleic acid hydrazide | 0.0087 |
| Sorbitol | 0.53 |
| Glycerin | 0.57 |
| Potassium Bromide | 0.14 |
| Resorcinol | 0.44 |
| DXOC-1 | 0.54 |
| Bis(vinylsulfonylmethyl)ether | 2.4% |

(based on wt. of gelatin in all layers of the back side of the support)

The same chemically and spectrally sensitized silver bromide tabular grain emulsion was employed in the inner emulsion layer as was employed in the outer emulsion layer.

Radiographic Element Dc

This element was identical to radiographic element Cc, except that the coating coverage of DXOC-1 in each of the inner emulsion layers was doubled to 1.08.

Radiographic Element Ec

This element was identical to radiographic element Dc, except that the coating coverage of DXOC-1 in each of the inner emulsion layers was doubled to 2.16.

Radiographic Elements Fc, Gc and Hc

Elements Fc, Gc and Hc were each identical to radiographic elements Cc, Dc and Ec, respectively, except that the same monodisperse (COV=10%) emulsion employed in radiographic element Ac was substituted for the emulsion in each inner emulsion layer. The emulsion layer silver coating coverages were identical in each of elements Cc through Hc.

Radiographic Elements Ic, Jc and Ke

Elements Ic, Jc and Ke were each identical to radiographic elements Cc, Dc and Ec, respectively, except that the silver bromide grains in the lower emulsion layer were doped with $9.7\times10^{-9}$ mole per silver mole of rhodium introduced by addition of $(NH_4)_3RhCl_6$ during grain precipitation.

Evaluations

Samples of the dual-coated elements were simultaneously exposed on each side for 1/50 sec through a graduated density step tablet using a MacBeth™ sensitometer having a 500 watt General Electric DMX™ projector lamp calibrated to 2650° K and filtered through a Corning C4010™ filter (480–600 nm, 530 nm peak transmission).

The samples were processed using a Kodak X-Omat RA 480 processor. This processor can be set to any one of the overall processing cycles set out in Table I.

TABLE I

| Cycle Times in Seconds | | | | | |
|---|---|---|---|---|---|
| Cycle | Extended | Standard | Rapid | KWIK | Super KWIK |
| Develop | 44.9 | 27.6 | 15.1 | 11.1 | 8.3 |
| Fix | 37.5 | 18.3 | 12.9 | 9.4 | 7.0 |
| Wash | 30.1 | 15.5 | 10.4 | 7.6 | 5.6 |
| Dry | 47.5 | 21.0 | 16.6 | 12.2 | 9.1 |
| Total | 160.0 | 82.4 | 55 | 40.3 | 30.0 |

The processing cycles employed the following developers and fixers, where component concentrations are expressed in g/L:

| Extended, Standard and Rapid developer: | |
|---|---|
| Hydroquinone | 30 |
| 4-Hydroxymethyl-4-methyl-1-phenyl-3-pyrazolidinone | 1.5 |
| Potassium hydroxide | 21.00 |
| 5-Methylbenzotriazole | 0.06 |
| Sodium bicarbonate | 7.5 |
| Potassium sulfite | 44.2 |
| Sodium metabisulfite | 12.6 |
| Sodium bromide | 35.0 |
| Glutaraldehyde | 4.9 |
| Water to 1 liter | |
| pH | 10 |
| **Extended, Standard and Rapid fixer:** | |
| Ammonium thiosulfate, 60% | 260 |
| Sodium bisulfite | 180 |
| Boric acid | 25 |
| Acetic acid | 10 |
| Aluminum sulfate | 8 |
| Water to 1 liter | |
| pH 3.9 to 4.5 | |
| **KwiK developer:** | |
| Hydroquinone | 32 |
| 4-Hydroxymethyl-4-methyl-1-phenyl-3-pyrazolidinone | 6.0 |
| Potassium bromide | 2.25 |
| 5-Methylbenzotriazole | 0.125 |
| Sodium sulfite | 160 |
| Glutaraldehyde | 4.9 |
| Water to 1 liter | |
| pH | 10.5 |
| **Kwik fixer:** | |
| Potassium hydroxide | 3.2 |
| Glacial acetic acid | 9.6 |
| Ammonium thiosulfate | 100 |
| Ammonium sulfite | 7.1 |
| Sodium tetraborate pentahydrate | 4.4 |
| Tartaric acid | 3.0 |
| Sodium metabisulfite | 6.6 |
| Aluminum sulfate | 3.3 |
| Water to 1 liter | |
| pH | 4.9 |

-continued

| Super Kwik developer: | |
|---|---|
| Potassium hydroxide | 23 |
| Sodium sulfite | 12 |
| 1-Phenyl-5-mercatotetrazole | 0.02 |
| Sequestrant* | 2.8 |
| Sodium bicarbonate | 7.4 |
| Potassium sulfite | 70.8 |
| Diethylene glycol | 15 |
| Hydroquinone | 30 |
| Glutaraldehyde | 3.9 |
| Glacial acetic acid | 10 |
| 1-Phenyl-3-pyrazolidone | 12 |
| 5-nitroindazole | 0.12 |
| Water to 1 liter | |
| pH | 10.6 |
| Super Kwik fixer: | |
| Potassium hydroxide | 7.4 |
| Acetic acid | 18 |
| Sodium thiosulfate | 16 |
| Potassium iodide | 0.08 |
| Ammonium thiosulfate | 122 |
| Ammonium sulfite | 8.6 |
| Sodium metabisulfite | 2.9 |
| Sodium glutonate | 5.0 |
| Aluminum sulfate | 7.0 |
| Water to 1 liter | |
| pH | 4.7 |

*diethylenetriaminopentaacetic acid pentasodium salt

The glutaraldehyde had little effect on the elements, since they were fully forehardened.

To compare the ability of the processor to dry the elements, film samples were flash exposed to provide a density of 1.0 when processed. As each film sample started to exit the processor, the processor was stopped, and the sample was removed from the processor. Roller marks were visible on the film in areas that had not dried. A film that was not dry as it left the processor was assigned a % dryer value of 100+. A film that exhibited roller marks from first encountered guide rollers, but not the later encountered guide rollers, indicating that the film had already dried when passing over the latter rollers, was assigned a % dryer value indicative of percentage of the rollers that were guiding undried portions of the film. Hence lower % dryer values indicate quicker drying film samples.

To permit crossover determinations samples of the Elements were exposed with a Lanex Regular™ green emitting intensifying screen in contact with one side of the sample and black kraft paper in contact with the other side of the sample. The X-radiation source was a Picker VGX653 3-phase X-ray machine, with a Dunlee High-Speed PX1431-CQ-150 kVp 0.7/1.4 focus tube. Exposure was made at 70 kVp, 32 mAs, at a distance of 1.40 m. Filtration was with 3 mm Al equivalent (1.25 inherent+1.75 Al); Half Value Layer (HVL)-2.6 mm Al. A 26 step Al step wedge was used, differing in thickness by 2 mm per step.

Processing of these samples was undertaken as described above. By removing emulsion from the side of the support nearest the screen at some sample locations and from the side of the support opposite the screen at other sample locations the density produced on each side of the support at each step was determined. From this separate characteristic (density vs. log E) curves were plotted for each emulsion layer. The exposure offset between the curves was measured at three locations between the toe and shoulder portions of the curves and averaged to obtain A log E for use in equation (I), above.

The drying characteristics of the elements using the rapid and two faster processing cycles is reported in Table II.

TABLE II

| | Process Cycle | | |
|---|---|---|---|
| Elements | 55" | 40" | 30" |
| A and B | 90% | >100% | >100% |
| C through K | <50% | 60% | 70% |

From Table II it is apparent that the conventional asymmetrical thoracic cavity imaging element A as well as modified element B are limited in the degree to which their processing can be accelerated. The symmetrical elements C through K, by separating the silver halide emulsion into inner and outer layers on each side of the support and consolidating crossover control dye in the inner emulsion layers instead of employing separate crossover control layers, as is conventional practice, allow processing times of less than 45 seconds and even less than 30 seconds to be realized. All attempts to lower gelatin coverages in asymmetrical radiographic elements having the coating format of Ac and Bc have resulted in unacceptable levels of wet pressure sensitivity. All gelatin coating coverages reported above were selected to obviate performance degradation attributable to wet pressure sensitivity.

To allow the performance characteristics of all elements to be compared, the results from the rapid processing cycle are reported in Table II. All of the symmetrical elements produced similar sensitometric results when processed in the KWIK and Super KWIK cycles.

TABLE III (deficient performance highlighted)

| RE | Varied Features | % CO | $\gamma_1$ | $\gamma_2$ | $\gamma_3$ |
|---|---|---|---|---|---|
| Ac | MDEL\|XOD\|\|XOD\|PDEL | 3 | **2.9** | **1.4** | 0.7 |
| Bc | PDEL\|XOD\|\|XOD\|PDEL | 3 | **2.5** | **1.3** | 0.8 |
| Cc | PDOEL\|PDIEL + XOD\|\| | 23 | 3.6 | 1.6 | **0.2** |
| Dc | PDOEL\|PDIEL + XOD\|\| | 10 | **2.9** | 1.6 | **0.5** |
| Ec | PDOEL\|PDIEL + XOD\|\| | 3 | **2.4** | 1.7 | 0.7 |
| Fc | PDOEL\|MDIEL + XOD\|\| | 24 | 4.4 | **1.4** | **0.2** |
| Gc | PDOEL\|MDIEL + XOD\|\| | 9 | 3.6 | 1.6 | **0.5** |
| Hc | PDOEL\|MDIEL + XOD\|\| | 3 | **2.7** | 1.7 | 0.7 |
| Ic | PDOEL\|PDIEL + XOD + Ph\|\| | 24 | 5.5 | **1.3** | **0** |
| Jc | PDOEL\|PDIEL + XOD + Rh\|\| | 10 | 4.4 | **1.4** | **0.25** |
| Ke | PDOEL\|PDIEL + XOD + Ph\|\| | 3 | 3.4 | 1.7 | 0.7 |

$\gamma_1$ = Point gamma at ref. pt. D = 2.0 above $D_{min}$
$\gamma_2$ = Point gamma at 0.3 log E exposure < ref. pt.
$\gamma_3$ = Point gamma at 6.0 log E exposure < ref. pt.
PD = Polydisperse (COV > 30%)
MD = Monodisperse (COV ≦ 10%)
EL = Emulsion Layer
U = Upper
L = Lower Only radiographic element Ke fully satisfies the point gamma requirements of the invention. At $\gamma_1$, which is representative of lung tissue image regions, the point gamma exceeds 3.0, whereas radiographic element A, which is current use for thoracic imaging, comes close to a $\gamma_1$ point gamma of 3.0, but falls somewhat short. All of the remaining elements other than Ac and Ke fail to satisfy a $\gamma_1$ point gamma of 3.0 or fail to satisfy mediastinum image region $\gamma_3$ point gamma of at greater than 0.5. Some of these elements additionally fail to satisfy the required intermediate exposure region $\gamma_2$ point gamma of at least 1.5.

Element Bc demonstrates that replacing the monodisperse emulsion in element Ac adversely lowers both $\gamma_1$ and $\gamma_2$ point gammas.

When a symmetrical format is adopted that employs polydisperse emulsions in both the inner and outer emulsion layers on each side of the support, $\gamma_3$point contrast fails at the crossover levels of 23% (a high crossover level), see element Cc. At a crossover level of 10% (a nominally low crossover level), neither $\gamma_1$ and $\gamma_3$ point gamma requirements are met, see element Dc. At a still lower crossover level $\gamma_1$ point gamma requirements are not met by a wider margin, see element Ec.

Noting that element Ac, which is in current use for thoracic cavity imaging, contains both polydisperse and monodisperse emulsions, it was assumed that replacing the polydispere lower emulsion layer with a mondisperse inner emulsion layer would improve thoracic cavity imaging performance. At 24% (element Fc) and 9% (element Gc) crossover levels $\gamma_1$ point gamma was excellent, but $\gamma_3$ point contrast failed to satisfy mediastinum imaging requirements. When crossover was further reduced to 3% (element Hc), $\gamma_1$ point gamma fell well below 3.0. The failure of elements Fc, Gc and Hc to satisfy imaging requirements indicated that decreasing grain size dispersity, known to increase image contrast, could not be used to construct a radiographic element that would simultaneously satisfy the diagnostic image requirements for heart and lung image areas.

It was therefore surprising that the addition of rhodium to the polydisperse inner emulsion layer of symmetrical radiographic element Ke simultaneously provided excellent $\gamma_1$, $\gamma_2$ and $\gamma_3$ point gammas. What was even more surprising was that the excellent $\gamma_1$, $\gamma_2$ and $\gamma_3$ point gammas could only be realized when crossover was reduced below 5 percent. In this regard it should be noted that dual-coated radiographic elements having crossover levels of 10 percent and lower are routinely lumped together as being "low crossover" radiographic elements. This is the first occurrence observed when the difference between imaging success and failure has turned on maintaining a crossover percentage of less than 5 percent.

Thus, the thoracic cavity imaging radiographic elements of the invention depend for their superior performance upon a combination of features that have never previously been employed in combination or recognized to provide the needed combination of properties for processing in less than 45 seconds and satisfying selected point gammas indicative of thoracic cavity diagnostic image quality requirements.

There was little (<0.05 log E) variance among the elements in terms of imaging speed measured at a density of 1.0 above minimum density. It was unexpected that rhodium could be introduced into the emulsions without incurring a substantial speed loss.

The invention has been described in detail with particular reference to preferred embodiments thereof, but it will be understood that variations and modifications can be effected within the spirit and scope of the invention.

What is claimed is:

1. A medical diagnostic radiographic element comprised of a film support having first and second major surfaces and capable of transmitting radiation to which the radiographic element is responsive and, coated on each of the major surfaces, processing solution permeable hydrophilic colloid layers which are fully forehardened including at least one spectrally sensitized tabular grain emulsion, a particulate dye (a) capable of absorbing radiation to which the silver halide grains are responsive, (b) present in an amount sufficient to reduce crossover to less than 5 percent, and (c) capable of being substantially decolorized during processing, WHEREIN, to facilitate medical diagnostic imaging of thoracic cavity anatomical features as well as rapid processing with low wet pressure sensitivity in a symmetrical film format, less than 35 mg/dm$^2$ of hydrophilic colloid is coated on each of the major surfaces of the support, the hydrophilic colloid layers including on each major surface of the support inner and outer emulsion layers containing a spectrally sensitized tabular grain emulsion having a grain equivalent circular diameter coefficient of variation of greater than 25 percent, the outer layers being coated over the inner layers, the outer emulsion layers contain (a) silver halide grains accounting for from 30 to 70 percent of the total weight of the outer emulsion layers, and (b) from 20 to 80 percent of the total silver forming the silver halide grains within the radiographic element, the inner emulsion layers contain (a) the dye particles and (b) from 20 to 80 percent of the total silver forming the silver halide grains within the radiographic element, the dye particles and the silver halide grains together account for from 30 to 70 percent of the total weight of each of the inner emulsion layers, and the silver halide grains within the inner emulsion layers contain a rhodium dopant to increase point $\gamma$(a) to greater than 3.0 at a first reference point at a density of 2.0 above minimum density, (b) to greater than 1.5 at a second reference point lying at a 0.3 log E lower exposure than the first reference point, and (c) to greater than 0.5 at a third reference point lying at a 0.6 log E lower exposure than the first reference point.

2. A thoracic cavity imaging radiographic element according to claim 1 wherein the silver halide grains in the inner emulsion layers contain rhodium in a normalized molar concentration of less than $10^{-6}$ based on silver.

3. A thoracic cavity imaging radiographic element according to claim 1 wherein the rhodium dopant is present in a normalized molar concentration in the range of from $1\times10^{-9}$ to $1\times10^{-7}$ based on silver.

4. A thoracic cavity imaging radiographic element according to claim 3 wherein the rhodium dopant is present in a normalized molar concentration in the range of from $5\times10^{-9}$ to $5\times10^{-8}$ based on silver.

5. A thoracic cavity imaging radiographic element according to claim 1 wherein the tabular grains in each of the emulsion layers have an average thickness of at least 0.1 $\mu$m.

6. A thoracic cavity imaging radiographic element according to claim 1 wherein the tabular grains in each of the emulsion layers have a thickness of less than 0.2 $\mu$m account for at least 70 percent of total grain projected area.

7. A thoracic cavity imaging radiographic element according to claim 1 wherein the radiographic element can be processed by the following processing cycle:

| | |
|---|---|
| development | 15.1 seconds |
| fixing | 12.9 seconds |
| washing | 10.4 seconds |
| drying | 16.6 seconds |

employing a hydroquinone-pyrazolidinone developer.

* * * * *